US009458400B2

(12) United States Patent
Fang

(10) Patent No.: US 9,458,400 B2
(45) Date of Patent: Oct. 4, 2016

(54) FUEL ADDITIVE FOR IMPROVED PERFORMANCE IN DIRECT FUEL INJECTED ENGINES

(71) Applicant: Afton Chemical Corporation, Richmond, VA (US)

(72) Inventor: Xinggao Fang, Midlothian, VA (US)

(73) Assignee: Afton Chemical Corporation, Richmond, VA (US)

( * ) Notice: Subject to any disclaimer, the term of this patent is extended or adjusted under 35 U.S.C. 154(b) by 333 days.

(21) Appl. No.: 14/270,738

(22) Filed: May 6, 2014

(65) Prior Publication Data

US 2014/0238328 A1 Aug. 28, 2014

Related U.S. Application Data

(63) Continuation-in-part of application No. PCT/US2012/063189, filed on Nov. 2, 2012.

(51) Int. Cl.

| | |
|---|---|
| ***C10L 1/00*** | (2006.01) |
| ***C10L 1/222*** | (2006.01) |
| ***C10L 10/18*** | (2006.01) |

(52) U.S. Cl.

CPC ..... *C10L 1/2222* (2013.01); *C10L 1/2225* (2013.01); *C10L 10/18* (2013.01); *C10L 2200/0423* (2013.01); *C10L 2270/023* (2013.01)

(58) Field of Classification Search

CPC ..... C10L 1/006; C10L 1/222; C10L 1/2225; C10L 10/18; C10L 2200/0423; C10L 2270/023; C10L 2270/0232

See application file for complete search history.

(56) References Cited

U.S. PATENT DOCUMENTS

| | | | | |
|---|---|---|---|---|
| 3,015,668 | A | 1/1962 | Kozikowski | |
| 3,162,686 | A * | 12/1964 | Harris | C06B 25/00 44/422 |
| 3,387,954 | A * | 6/1968 | Capowski | C10L 1/222 252/389.21 |
| 3,468,640 | A | 9/1969 | Barusch et al. | |
| 3,778,371 | A | 12/1973 | Malec | |
| 3,880,613 | A * | 4/1975 | Oswald | C10L 1/143 44/370 |
| 4,056,531 | A * | 11/1977 | Malec | C07D 213/20 544/107 |

(Continued)

FOREIGN PATENT DOCUMENTS

| | | | |
|---|---|---|---|
| EP | 0293192 | A1 | 11/1988 |
| EP | 2033945 | A1 | 3/2009 |
| JP | 2002317123 | A1 | 10/2002 |

*Primary Examiner* — Cephia D Toomer

(74) *Attorney, Agent, or Firm* — Luedeka Neely Group, P.C.

(57) ABSTRACT

A fuel composition for a direct fuel injected gasoline engine comprising, a method for improving performance of fuel injectors and a method for cleaning fuel injectors for an internal combustion gasoline engine. The fuel composition includes a major amount of fuel and a minor, effective amount of a quaternary ammonium salt having a thermo-gravimetric analysis (TGA) weight loss of greater than 50 wt. % at 350° C. The amount of quaternary ammonium salt present in the fuel is sufficient to improve performance of the direct fuel injected engine having combusted the composition compared to the performance of such engine having combusted a fuel composition that does not contain the quaternary ammonium salt.

19 Claims, 1 Drawing Sheet

(56) References Cited

U.S. PATENT DOCUMENTS

| | | | |
|---|---|---|---|
| 4,152,499 | A | 5/1979 | Boerzel et al. |
| 4,168,268 | A | 9/1979 | Datta et al. |
| 4,171,959 | A | 10/1979 | Vartanian |
| 4,253,980 | A | 3/1981 | Hammond et al. |
| 4,326,973 | A | 4/1982 | Hammond et al. |
| 4,338,206 | A | 7/1982 | Hammond et al. |
| 4,482,357 | A | 11/1984 | Hanlon |
| 4,675,180 | A | 6/1987 | Gunter |
| 4,787,916 | A | 11/1988 | Feldman |
| 4,814,108 | A | 3/1989 | Geke et al. |
| 5,248,315 | A | 9/1993 | Gatti et al. |
| 5,254,138 | A | 10/1993 | Kurek |
| 5,468,368 | A | 11/1995 | Baker et al. |
| 5,575,823 | A | 11/1996 | Wallace et al. |
| 5,752,989 | A | 5/1998 | Henly et al. |
| 5,756,428 | A | 5/1998 | Emert et al. |
| 7,112,230 | B2 | 9/2006 | Malfer et al. |
| 7,491,248 | B2 | 2/2009 | Colucci et al. |
| 7,901,470 | B2 | 3/2011 | Graupner et al. |
| 7,906,470 | B2 | 3/2011 | Stevenson et al. |
| 7,947,093 | B2 | 5/2011 | Barton et al. |
| 7,951,211 | B2 | 5/2011 | Barton et al. |
| 2003/0131527 | A1 | 7/2003 | Colucci et al. |
| 2008/0113890 | A1 | 5/2008 | Moreton et al. |
| 2010/0204521 | A1 | 8/2010 | Harmer et al. |
| 2010/0281760 | A1 | 11/2010 | Reid |
| 2011/0308550 | A1 | 12/2011 | Reid |
| 2013/0031827 | A1 | 2/2013 | Reid et al. |
| 2013/0031828 | A1 | 2/2013 | Reid et al. |
| 2013/0233267 | A1 | 9/2013 | Barbour |

* cited by examiner

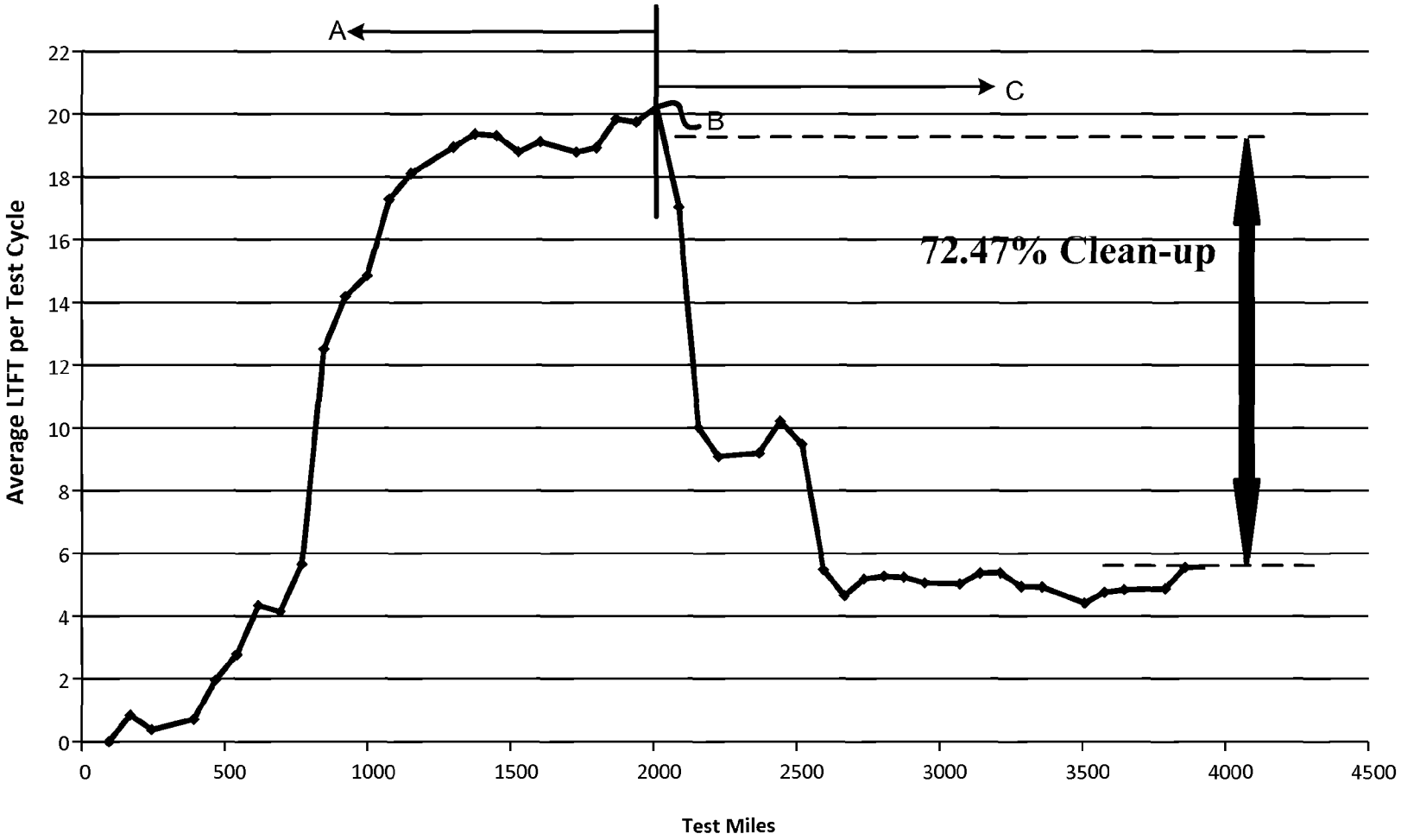
A
B
C
72.47% Clean-up
Average LTFT per Test Cycle
Test Miles
0
2
4
6
8
10
12
14
16
18
20
22
0
500
1000
1500
2000
2500
3000
3500
4000
4500

FUEL ADDITIVE FOR IMPROVED PERFORMANCE IN DIRECT FUEL INJECTED ENGINES

TECHNICAL FIELD

The disclosure is directed to fuel additives and to additive and additive concentrates that include the additive that are useful for improving the performance of direct fuel injected gasoline engines (DIG).

BACKGROUND AND SUMMARY

It has long been desired to maximize fuel economy, power and driveability in gasoline powered vehicles while enhancing acceleration, reducing emissions, and preventing hesitation. While it is known to enhance gasoline powered engine performance by employing dispersants to keep valves and fuel injectors clean in port fuel injection engines, such gasoline dispersants are not necessarily effective for cleaning up direct fuel injected engines. The reasons for this unpredictability may lie in the many mechanical and operational differences between the direct and port fuel injected engines and the fuels suitable for such engines.

With the current use of direct fuel injected gasoline engines, dispersants that previously could have been used for gasoline engines do not work for both direct injected engines and port fuel injected engines. For example Mannich dispersants that were used in port fuel injected gasoline engines fail to provide suitable improvement in direct injected gasoline engines.

Over the years, dispersant compositions for gasoline fuels have been developed. Dispersant compositions known in the art for use in fuels include compositions that may include polyalkylene succinimides, polyalkenepolyamines, polyetheramines, and polyalkyl substituted Mannich compounds. Dispersants are suitable for keeping soot and sludge suspended in a fluid, however dispersants are not particularly effective for cleaning surfaces once deposits have formed on the surfaces. Hence, fuel compositions for direct fuel injected engines often produce undesirable deposits in the engines. Accordingly, improved compositions that can prevent deposit build up, maintaining "as new" cleanliness for the vehicle life are desired. Ideally, the same composition that can clean up dirty fuel injectors restoring performance to the previous "as new" condition would be equally desirable and valuable in the attempt to reduce air borne exhaust emissions and to improve the power performance of the engines.

In accordance with the disclosure, exemplary embodiments provide a fuel composition for an internal combustion gasoline engine comprising, a method for improving performance of fuel injectors and a method for operating a direct fuel injected gasoline engine. The fuel composition includes a major amount of fuel and from about 5 to about 200 ppm by weight of a quaternary ammonium salt having a thermogravimetric analysis (TGA) weight loss of greater than 50 wt. % at 350° C. The amount of quaternary ammonium salt present in the fuel is sufficient to improve performance of a direct fuel injected engine having combusted the composition compared to the performance of such engine having combusted a fuel composition that does not contain the quaternary ammonium salt. The quaternary ammonium salt is a compound of the formula

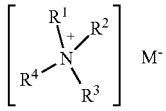

wherein each of $R^1$, $R^2$, $R^3$, and $R^4$ is selected from a hydrocarbyl group containing from 1 to 25 carbon atoms, wherein at least one and not more than three of $R^1$, $R^2$, $R^3$, and $R^4$ is a hydrocarbyl group containing from 1 to 4 carbon atoms and at least one of $R^1$, $R^2$, $R^3$, and $R^4$ is a hydrocarbyl group containing from 8 to 25 carbon atoms, M− is selected from the group consisting of carboxylates, nitrates, nitrides, nitrites, hyponitrites, carbonates, and mixtures thereof, wherein the carboxylate is not an oxalate or formate.

Another embodiment of the disclosure provides a method of improving the injector performance of a direct fuel injected internal combustion gasoline engine. The method includes operating the engine on a fuel composition containing a major amount of fuel and from about 5 to about 200 ppm by weight based on a total weight of the fuel of a quaternary ammonium salt having a thermogravimetric analysis (TGA) weight loss of greater than 50 wt. % at 350° C. The quaternary ammonium salt present in the fuel may improve injector performance by providing a reduction in LTFT of at least about 30%. The quaternary ammonium salt is a compound of the formula

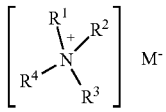

wherein each of $R^1$, $R^2$, $R^3$, and $R^4$ is selected from a hydrocarbyl group containing from 1 to 25 carbon atoms, wherein at least one and not more than three of $R^1$, $R^2$, $R^3$, and $R^4$ is a hydrocarbyl group containing from 1 to 4 carbon atoms and at least one of $R^1$, $R^2$, $R^3$, and $R^4$ is a hydrocarbyl group containing from 8 to 25 carbon atoms, M− is selected from the group consisting of carboxylates, nitrates, nitrides, nitrites, hyponitrites, carbonates, and mixtures thereof, wherein the carboxylate is not an oxalate or formate.

A further embodiment of the disclosure provides a method of operating a direct fuel injected gasoline engine. The method includes combusting in the engine a fuel composition comprising a major amount of fuel and from about 5 to about 200 ppm by weight based on a total weight of the fuel of a quaternary ammonium salt having a thermogravimetric analysis (TGA) weight loss of greater than 50 wt. % at 350° C. In further embodiments, the TGA weight loss is greater than 70 wt. %, such as greater than 80 wt. %, particularly greater than 90 wt. % weight loss. The quaternary ammonium salt is a compound of the formula

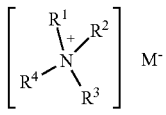

wherein each of $R^1$, $R^2$, $R^3$, and $R^4$ is selected from a hydrocarbyl group containing from 1 to 25 carbon atoms, wherein at least one and not more than three of $R^1$, $R^2$, $R^3$, and $R^4$ is a hydrocarbyl group containing from 1 to 4 carbon atoms and at least one of $R^1$, $R^2$, $R^3$, and $R^4$ is a hydrocarbyl group containing from 8 to 25 carbon atoms, M− is selected from the group consisting of carboxylates, nitrates, nitrides, nitrites, hyponitrites, carbonates, and mixtures thereof, wherein the carboxylate is not an oxalate or formate.

An advantage of the fuel additive described herein is that the additive may not only reduce the amount of deposits forming on direct fuel injectors, but the additive may also be effective to clean up dirty fuel injectors sufficient to provide improved engine performance.

Additional embodiments and advantages of the disclosure will be set forth in part in the detailed description which follows, and/or can be learned by practice of the disclosure. It is to be understood that both the foregoing general description and the following detailed description are exemplary and explanatory only and are not restrictive of the disclosure, as claimed.

BRIEF DESCRIPTION OF THE DRAWINGS

FIG. 1 is a graphical representation of the LFTF % versus time for a direct injected gasoline (DIG) engine combusting a fuel without an additive and with the additive of the disclosure.

DETAILED DESCRIPTION OF EXEMPLARY EMBODIMENTS

The fuel additive component of the present application may be used in a minor amount in a major amount of fuel and may be added to the fuel directly or added as a component of an additive concentrate to the fuel. A particularly suitable fuel additive component for improving the operation of internal combustion gasoline engines may be made by a wide variety of well known reaction techniques with amines or polyamines. For example, such additive component may be made by reacting a tertiary amine of the formula

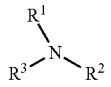

wherein each of $R^1$, $R^2$, and $R^3$ is selected from hydrocarbyl groups containing from 1 to 50 carbon atoms, with a quaternizing agent to provide a compound of the formula:

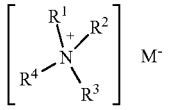

wherein each of $R^1$, $R^2$, $R^3$, and $R^4$ is selected from hydrocarbyl groups containing from 1 to 50 carbon atoms, wherein at least one and not more than three of $R^1$, $R^2$, $R^3$, and $R^4$ is a hydrocarbyl group containing from 1 to 4 carbon atoms and at least one of $R^1$, $R^2$, $R^3$, and $R^4$ is a hydrocarbyl group containing from 8 to 50 carbon atoms, $M^-$ is selected from the group consisting of a carboxylate, a nitrate, a nitride, a nitrite, a hyponitrite, a phenate, a carbamate, a carbonate, a halide, a sulfate, a sulfite, a sulfide, a sulfonate, a phosphate, a phosphonate, and the like. In one embodiment, $R^1$, $R^2$, $R^3$, and $R^4$ are each selected from hydrocarbyl groups containing from 1 to 25 carbon atoms, provided at least one of $R^1$, $R^2$, $R^3$, and $R^4$ contains from 8 to 25 carbon atoms. In another embodiment, $R^1$, $R^2$, $R^3$, and $R^4$ are each selected from hydrocarbyl groups containing from 1 to 20 carbon atoms, provided at least one of $R^1$, $R^2$, $R^3$, and $R^4$ contains from 8 to 20 carbon atoms. In another embodiment, each of $R^1$, $R^2$, $R^3$, and $R^4$ is selected from an alkyl or alkenyl group.

Suitable quaternizing agents may be selected from the group consisting of hydrocarbyl substituted carboxylates, carbonates, cyclic-carbonates, phenates, epoxides, or mixtures thereof. In one embodiment, the quaternizing agent may be derived from a hydrocarbyl (or alkyl) substituted carbonate. In another embodiment the quaternizing agent may be selected from a hydrocarbyl substituted epoxide. In another embodiment the quaternizing agent may be selected from a hydrocarbyl substituted carboxylate. In one embodiment, the carboxylate quaternizing agent excludes oxalates and formates.

As used herein, the term "hydrocarbyl group" or "hydrocarbyl" is used in its ordinary sense, which is well-known to those skilled in the art. Specifically, it refers to a group having a carbon atom directly attached to the remainder of a molecule and having a predominantly hydrocarbon character. Examples of hydrocarbyl groups include:

(1) hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form an alicyclic radical);

(2) substituted hydrocarbon substituents, that is, substituents containing non-hydrocarbon groups which, in the context of the description herein, do not alter the predominantly hydrocarbon substituent (e.g., halo (especially chloro and fluoro), hydroxy, alkoxy, mercapto, alkylmercapto, nitro, nitroso, amino, alkylamino, and sulfoxy);

(3) hetero-substituents, that is, substituents which, while having a predominantly hydrocarbon character, in the context of this description, contain other than carbon in a ring or chain otherwise composed of carbon atoms. Hetero-atoms include sulfur, oxygen, nitrogen, and encompass substituents such as pyridyl, furyl, thienyl, and imidazolyl. In general, no more than two, or as a further example, no more than one, non-hydrocarbon substituent will be present for every ten carbon atoms in the hydrocarbyl group; in some embodiments, there will be no non-hydrocarbon substituent in the hydrocarbyl group.

As used herein, the term "major amount" is understood to mean an amount greater than or equal to 50 wt. %, for example from about 80 to about 98 wt. % relative to the total weight of the composition. Moreover, as used herein, the term "minor amount" is understood to mean an amount less than 50 wt. % relative to the total weight of the composition.

Methods for making quaternary ammonium salts include but are not limited to by ion exchange reactions, or by direct alkylation of a tertiary amine or polyamine. Direct alkylation may include methylation of tertiary amines such as pyridine and isoquinoline with methyl carboxylates, or alkylation of a tertiary amine with a hydrocarbyl epoxide in a one or two step reaction.

Amine Compound

In one embodiment, a tertiary amine including monoamines and polyamines may be reacted with a quaternizing agent. Suitable tertiary amine compounds of the formula

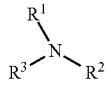

wherein each of $R^1$, $R^2$, and $R^3$ is selected from hydrocarbyl groups containing from 1 to 50 carbon atoms may be used. Each hydrocarbyl group $R^1$ to $R^3$ may independently be linear, branched, substituted, cyclic, saturated, unsaturated, or contain one or more hetero atoms. Suitable hydrocarbyl groups may include, but are not limited to alkyl groups, aryl groups, alkylaryl groups, arylalkyl groups, alkoxy groups, aryloxy groups, and the like.

In one embodiment, $R^1$, $R^2$, $R^3$, and $R^4$ are each selected from hydrocarbyl groups containing from 1 to 25 carbon atoms, provided at least one of $R^1$, $R^2$, $R^3$, and $R^4$ contains from 8 to 25 carbon atoms. In another embodiment, R1, R2, R3, and R4 are each selected from hydrocarbyl groups containing from 1 to 20 carbon atoms, provided at least one of R1, R2, R3, and R4 contains from 8 to 20 carbon atoms.

Particularly suitable hydrocarbyl groups may be linear or branched alkyl groups. Some representative examples of amine reactants which can be quaternarized to yield compounds of this invention are: trimethyl amine, triethyl amine, tri-n-propyl amine, dimethylethyl amine, dimethyl lauryl amine, dimethyl oleyl amine, dimethyl stearyl amine, dimethyl eicosyl amine, dimethyl octadecyl amine, N-methyl piperidine, N,N'-dimethyl piperazine, N-methyl-N-ethyl piperazine, N-methyl morpholine, N-ethyl morpholine, N-hydroxyethyl morpholine, pyridine, triethanol amine, triisopropanol amine, methyl diethanol amine, dimethyl ethanol amine, lauryl diisopropanol amine, stearyl diethanol amine, dioleyl ethanol amine, dimethyl isobutanol amine, methyl diisooctanol amine, dimethyl propenyl amine, dimethyl butenyl amine, dimethyl octenyl amine, ethyl didodecenyl amine, dibutyl eicosenyl amine, triethylene diamine, hexamethylene tetramine, N,N,N',N'-tetramethylethylenediamine, N,N,N',N'-tetramethylpropylenediamine, N,N,N',N'-tetraethyl-1,3-propanediamine, methyldicyclohexyl amine, 2,6-dimethylpyridine, dimethylcylohexylamine, $C_{10}$-$C_{22}$-alkyl or alkenyl-substituted amidopropyldimethylamine, $C_{10}$-$C_{22}$-alkyl or alkenyl-substituted succinicimidopropyldimethylamine, and the like.

If the amine contains solely primary or secondary amino groups, it is necessary to alkylate at least one of the primary or secondary amino groups to a tertiary amino group prior to quaternizing the amine. In one embodiment, alkylation of primary amines and secondary amines or mixtures with tertiary amines may be exhaustively or partially alkylated to a tertiary amine and further alkylated to a quaternary salt all in one step. If a one step reaction is used, it may be necessary to properly account for the hydrogens on the nitrogens and provide base or acid as required (e.g., alkylation up to the tertiary amine requires removal (neutralization) of the hydrogen (proton) from the product of the alkylation). If alkylating agents, such as, alkyl halides or dialkyl sulfates are used, the product of alkylation of a primary or secondary amine is a protonated salt and needs a source of base to free the amine and to proceed to the quaternary salt. Such alkylating agents require alkylation of the tertiary amine, and the product is the quaternary ammonium halide or monomethyl sulfate. By contrast, epoxides as alkylating agents do both the alkylation and the neutralization such that the intermediate alkylation product is already the free amine. To proceed to the quaternary salt with epoxides it is necessary to provide an equivalent of an acid to provide a proton for the hydroxy group and a counter anion for the salt.

Quaternizing Agent

The quaternizing agent suitable for converting the tertiary amine to a quaternary nitrogen compound may be selected from the group consisting of hydrocarbyl substituted carboxylates, carbonates, cyclic carbonates, phenates, epoxides, carbamates, halides, sulfates, sulfites, sulfides, sulfonates, phosphates, phosphonates, or mixtures thereof. The hydrocarbyl-substituted phenates from which the anion of the quaternary ammonium compound may be derived are of many different types. For example, hydrocarbyl-substituted phenates may be derived from phenols of the formula:

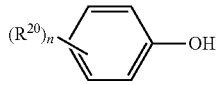

wherein n=1, 2, 3, 4 or 5, where $R^{20}$ may be hydrogen, or a substituted or unsubstituted, alkyl, cycloalkyl, alkenyl, cycloalkenyl or aryl group. The hydrocarbon group(s) may be bonded to the benzene ring by a keto or thio-keto group. Alternatively the hydrocarbon group(s) may be bonded through an oxygen, or nitrogen atom. Examples of such phenols include o-cresol; m-cresol; p-cresol; 2,3-dimethylphenol; 2,4-dimethylphenol; 2,3,4-trimethylphenol; 3-ethyl-2,4-dimethylphenol; 2,3,4,5-tetramethylphenol; 4-ethyl 2,3,5,6-tetramethylphenol; 2-ethylphenol; 3-ethylphenol; 4-ethylphenyl; 2-n-propylphenol; 2-isopropylphenol; 4-isopropylphenol; 4-n-butylphenol; 4-isobutylphenol; 4-secbutylphenol; 4-t-butylphenol; 4-nonylphenol; 2-dodecylphenol; 4-dodecylphenol; 4-octadecylphenol; 2-cyclohexylphenol; 4-cyclohexylphenol; 2-allylphenol; 4-allylphenol; 2-hydroxydiphenyl; 4-hydroxydiphenol; 4-methyl-4-hydroxydiphenyl; o-methoxyphenol; p-methoxyphenol; p-phenoxyphenol; and 4-hydroxyphenyldimethylamine.

Also included are phenols of the formula:

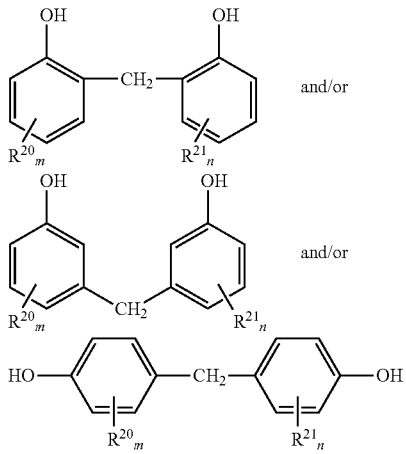

wherein $R^{20}$ and $R^{21}$ which may be the same or different are as defined above for $R^{20}$ and m and n are integers and for each m or n greater than 1 each $R^{20}$ and $R^{21}$ may be the same or different.

Examples of such phenols include 2,2-dihydroxy-5,5-dimethyldiphenylmethane; 5,5-dihydroxy-2,2-dimethyldiphenylmethane; 4,4-dihydroxy-2,2-dimethyl-dimethyldiphenylmethane; 2,2-dihydroxy-5,5-dinonyldiphenylmethane; 2,2-dihydroxy-5,5-didodecylphenylmethane; 2,2,4,4-tetra-t-butyl-3,3-dihydroxy-5,5-didodecylphenylmethane; and 2,2,4,4-tetra-t-butyl-3,3-dihydroxydiphenylmethane.

The hydrocarbyl (or alkyl) groups of the hydrocarbyl substituted carbonates may contain 1 to 50, 1 to 20, 1 to 10 or 1 to 5 carbon atoms per group. In one embodiment, the hydrocarbyl substituted carbonates contain two hydrocarbyl groups that may be the same or different. Examples of suitable hydrocarbyl substituted carbonates include dimethyl, diethyl, ethylene, and propylene carbonates and mixtures thereof.

In another embodiment, the quaternizing agent can be a hydrocarbyl epoxide, as represented by the following formula, in combination with an acid:

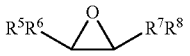

wherein $R^5$, $R^6$, $R^7$ and $R^8$ may be independently H or a $C_{1-48}$ hydrocarbyl group. Examples of hydrocarbyl epoxides may include, but are not limited to: styrene oxide, ethylene oxide, propylene oxide, butylene oxide, epoxyhexane, oct-11-ene oxide, stilbene oxide and $C_{2-50}$ epoxide.

The quaternary ammonium salts may be made in one stage or two stages. Alkylation of a tertiary amine with alkyl epoxide may be conducted in a one step reaction with acid present as set forth in U.S. Pat. Nos. 4,814,108, 4,675,180 or in a two step process that includes alkylation of the tertiary amine in polar medium then mixing the alkylated product with an acid. For example, 1 mole of the amine may be treated with X moles of the olefin oxide (where X is the number of tertiary nitrogens in the amine molecule) in the presence of an excess of water over that required by the stoichiometry of the reaction.

By way of further example, pyridine (1 mole) may be treated with an olefin oxide (1 mole) in water (>1 mole). Triethylenediamine (1 mole) may be treated with an olefin oxide (2 moles) in water (>2 mole). Hexamine (1 mole) may be treated with an olefin oxide (4 moles) in water (>4 moles).

However, the olefin oxide may be used in excess if required, or desired, the excess olefin oxide then reacting with the quaternary ammonium hydroxide. As indicated above any quantity of water may be used as long as it represents an excess over that required by the stoichiometry of the reaction.

The reaction may be carried out by contacting and mixing the amine with the olefin oxide in the reaction vessel wherein water is added to the reaction mixture. The rate of addition of the water does not affect the quality of the final product but slow addition of water may be used to control an exothermic reaction.

In the alternative, the amine may be mixed with water in the reaction vessel and the olefin oxide then added to the stirred reaction mixture. The olefin oxide may be added as a gas either pure or diluted with an inert carrier (e.g., nitrogen); a liquid; a solution in water; or a solution in a water miscible organic solvent (e.g., methyl or ethyl alcohol). The rate of addition of the olefin oxide is not critical for the quality of the final product but a slow addition rate may be used to control an exothermic reaction.

In another alternative reaction sequence, the olefin oxide may be mixed with the water in the reaction vessel and the amine added to the reaction mixture. The amine may be added as a pure gas, liquid or solid; a solution in water; a solution in a water soluble organic solvent. As with the olefin oxide and water addition, slow addition of the amine may be used to control an exothermic reaction.

To facilitate the reaction, the mixed reactants may be heated together at a given temperature while the third reactant is added at a rate sufficient to maintain a steady reaction rate and controllable reaction temperature. Alternatively the reactants may be heated in a pressure vessel but, when heating the reactants to promote the reaction, a temperature greater than 100° C. is desirably avoided to prevent decomposition of the quaternary ammonium hydroxide. The second stage of the reaction sequence comprises neutralization of the quaternary ammonium hydroxide formed in the first stage with the organic acid.

Generally, sufficient acid is mixed with the solution obtained from the first stage to neutralize the quaternary ammonium hydroxide. However, an excess of acid may be used if required, as for example when only one carboxylic acid group of a polybasic acid is to be neutralized. The neutralization reaction may be carried out in the absence of any solvent; in the presence of an alcohol, e.g., methanol, ethanol, isopropanol, 2-ethoxyethanol, 2-ethylhexanol, or ethylene glycol; in the presence of any other polar organic solvent, e.g., acetone, methyl ethyl ketone, chloroform, carbon tetrachloride, or tetrachloroethane; in the presence of a hydrocarbon solvent, e.g., hexane, heptane, white spirit, benzene, toluene or xylene; or in the presence of a mixture of any of the above solvents.

The organic acid which may be used in the second stage of the reaction and hence forms the anion in the quaternary ammonium salt may be, for example, a carboxylic acid, phenol, sulfurized phenol, or sulphonic acid.

The neutralization reaction may be carried out at ambient temperature but generally an elevated temperature is used. When the reaction is completed the water and any solvents used may be removed by heating the reaction product under vacuum. The product is generally diluted with mineral oil, diesel fuel, kerosene, or an inert hydrocarbon solvent to prevent the product from being too viscous.

In another embodiment, the quaternizing agent may be a hydrocarbyl-substituted carboxylate, also known as an ester of a carboxylic acid. The corresponding acids of the carboxylates may be selected from mono-, di-, and polycarboxylic acids. The mono-carboxylic acids may include an acid of the formula:

$$R—COOH$$

wherein R is hydrogen, or a substituted or unsubstituted alkyl, cycloalkyl, alkenyl, cycloalkenyl, or aryl group containing from 1 to 50 carbon atoms. Examples of such acids include formic acid, acetic acid, propionic acid, butyric acid, valeric acid, palmitic acid, stearic acid, cyclohexanecarboxylic acid, 2-methylcyclohexane carboxylic acid, 4-methylcyclohexane carboxylic acid, oleic acid, linoleic acid, linolenic acid, cyclohex-2-eneoic acid, benzoic acid, 2-methylbenzoic acid, 3-methylbenzoic acid, 4-methylbenzoic acid, salicylic acid, 2-hydroxy-4-methylbenzoic acid, 2-hydroxy-4-ethylsalicylic acid, p-hydroxybenzoic acid, 3,5-di-tert-butyl-4-hydroxybenzoic acid, o-aminobenzoic acid, p-aminobenzoic acid, o-methoxybenzoic acid and p-methoxybenzoic acid.

The dicarboxylic acids may include an acid of the formula:

$$HOOC—(CH_2)_n—COOH$$

wherein n is zero or an integer, including e.g. oxalic acid, malonic acid, succinic acid, glutaric acid, adipic acid, pimelic acid and suberic acid. Also included are acids of the formula

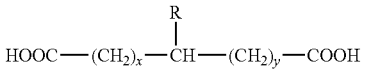

wherein x is zero or an integer, y is zero or an integer and x and y may be equal or different and R is hydrogen, or a substituted or unsubstituted alkyl, cycloalkyl, alkenyl, cycloalkenyl, or aryl group containing from 1 to 50 carbon atoms as described above. Examples of such acids include the alkyl or alkenyl succinic acids, 2-methylbutanedioic acid, 2-ethylpentanedioic acid, 2-n-dodecylbutanedioic acid, 2-n-dodecenylbutanedioic acid, 2-phenylbutanedioic acid, and 2-(p-methylphenyl)butanedioic acid. Also included are polysubstituted alkyl dicarboxylic acids wherein other R groups as described above may be substituted on the alkyl chain. Examples include 2,2-dimethylbutanedioic acid; 2,3-dimethylbutanedioic acid; 2,3,4-trimethylpentanedioic acid; 2,2,3-trimethylpentanedioic acid; and 2-ethyl-3-methylbutanedioic acid.

The dicarboxylic acids also include acids of the formula:

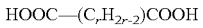

wherein r is an integer of 2 or more. Examples include maleic acid, fumaric acid, pent-2-enedioic acid, hex-2-enedioic acid; hex-3-enedioic acid, 5-methylhex-2-enedioic acid; 2,3-dimethylpent-2-enedioic acid; 2-methylbut-2-enedioic acid; 2-dodecylbut-2-enedioic acid; and 2-polyisobutylbut-2-enedioic acid.

The dicarboxylic acids also include aromatic dicarboxylic acids e.g. phthalic acid, isophthalic acid, terephthalic acid and substituted phthalic acids of the formula:

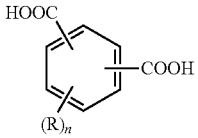

wherein R is defined as above and n=1, 2, 3 or 4 and when n>1 then the R groups may be the same or different. Examples of such acids include 3-methylbenzene-1,2-dicarboxylic acid; 4-phenylbenzene-1,3-dicarboxylic acid; 2-(1-propenyl)benzene-1,4-dicarboxylic acid, and 3,4-dimethylbenzene-1,2-dicarboxylic acid.

For alkylation with an alkyl carboxylate, it is desirable that the corresponding acid of the carboxylate have a pKa of less than 4.2. For example, the corresponding acid of the carboxylate may have a pKa of less than 3.8, such as less than 3.5, with a pKa of less than 3.1 being particularly desirable. Examples of suitable carboxylates may include, but not limited to, maleate, citrate, fumarate, phthalate, 1,2,4-benzenetricarboxylate, 1,2,4,5-benzenetetracarboxylate, nitrobenzoate, nicotinate, oxalate, aminoacetate, and salicylate.

In another embodiment, the quaternary ammonium salt may be prepared by ion exchange reactions such as

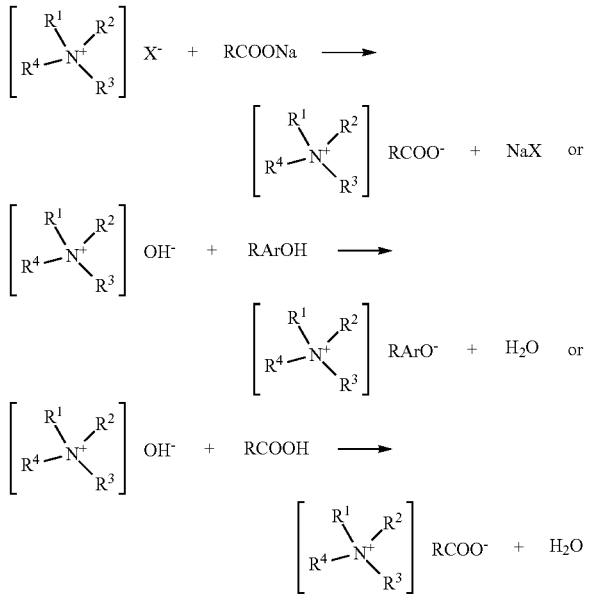

wherein X, is a halide, R is defined above and Ar is an aromatic group. The quat may also be prepared by direct alkylation of a tertiary amine or polyamine. Alkylating agents include but not limited to alkyl halide, alkyl carbonate, alkyl sulfate, cyclic carbonate, alkyl epoxide, alkyl carboxylate, and alkyl carbamate.

In some aspects of the present application, the quaternary ammonium salt compositions of this disclosure may be used in combination with a fuel soluble carrier. Such carriers may be of various types, such as liquids or solids, e.g., waxes. Examples of liquid carriers include, but are not limited to, mineral oil and oxygenates, such as liquid polyalkoxylated ethers (also known as polyalkylene glycols or polyalkylene ethers), liquid polyalkoxylated phenols, liquid polyalkoxylated esters, liquid polyalkoxylated amines, and mixtures thereof. Examples of the oxygenate carriers may be found in U.S. Pat. No. 5,752,989, issued May 19, 1998 to Henly et. al., the description of which carriers is herein incorporated by reference in its entirety. Additional examples of oxygenate carriers include alkyl-substituted aryl polyalkoxylates described in U.S. Patent Publication No. 2003/0131527, published Jul. 17, 2003 to Colucci et. al., the description of which is herein incorporated by reference in its entirety.

In other aspects, the quaternary ammonium salt compositions may not contain a carrier. For example, some compositions of the present disclosure may not contain mineral oil or oxygenates, such as those oxygenates described above.

One or more additional optional compounds may be present in the fuel compositions of the disclosed embodiments. For example, the fuels may contain conventional quantities of octane improvers, corrosion inhibitors, cold flow improvers (CFPP additive), pour point depressants, solvents, demulsifiers, lubricity additives, friction modifiers, amine stabilizers, combustion improvers, dispersants, antioxidants, heat stabilizers, conductivity improvers, metal deactivators, marker dyes, cyclomatic manganese tricarbonyl compounds, and the like. In some aspects, the compositions described herein may contain about 10 weight percent or less, or in other aspects, about 5 weight percent or less, based on the total weight of the additive concentrate, of one or more of the above additives. Similarly, the fuels may contain suitable amounts of conventional fuel blending components such as methanol, ethanol, dialkyl ethers, and the like.

Examples of suitable optional metal deactivators useful in the compositions of the present application are disclosed in U.S. Pat. No. 4,482,357 issued Nov. 13, 1984, the disclosure of which is herein incorporated by reference in its entirety. Such metal deactivators include, for example, salicylidene-o-aminophenol, disalicylidene ethylenediamine, disalicylidene propylenediamine, and N,N'-disalicylidene-1,2-diaminopropane.

Suitable optional cyclomatic manganese tricarbonyl compounds which may be employed in the compositions of the present application include, for example, cyclopentadienyl manganese tricarbonyl, methylcyclopentadienyl manganese tricarbonyl, indenyl manganese tricarbonyl, and ethylcyclopentadienyl manganese tricarbonyl. Yet other examples of suitable cyclomatic manganese tricarbonyl compounds are disclosed in U.S. Pat. No. 5,575,823, issued Nov. 19, 1996, and U.S. Pat. No. 3,015,668, issued Jan. 2, 1962, both of which disclosures are herein incorporated by reference in their entirety.

When formulating the fuel compositions of this application, the additives may be employed in amounts sufficient to reduce or inhibit deposit formation in a fuel system or combustion chamber of an engine and/or crankcase. In some aspects, the fuels may contain minor amounts of the above described reaction product that controls or reduces the formation of engine deposits, for example injector deposits in gasoline engines. For example, the gasoline fuels of this application may contain, on an active ingredient basis, an amount of the quaternary ammonium salt in the range of about 5 mg to about 200 mg of reaction product per Kg of fuel, such as in the range of about 10 mg to about 150 mg of per Kg of fuel or in the range of from about 30 mg to about 100 mg of the quaternary ammonium salt per Kg of fuel. In aspects, where a carrier is employed, the fuel compositions may contain, on an active ingredients basis, an amount of the carrier in the range of about 1 mg to about 100 mg of carrier per Kg of fuel, such as about 5 mg to about 50 mg of carrier per Kg of fuel. The active ingredient basis excludes the weight of (i) unreacted components associated with and remaining in the product as produced and used, and (ii) solvent(s), if any, used in the manufacture of the product either during or after its formation but before addition of a carrier, if a carrier is employed.

The additives of the present application, including the reaction product described above, and optional additives used in formulating the fuels of this invention may be blended into the base fuel individually or in various sub-combinations. In some embodiments, the additive components of the present application may be blended into the fuel concurrently using an additive concentrate, as this takes advantage of the mutual compatibility and convenience afforded by the combination of ingredients when in the form of an additive concentrate. Also, use of a concentrate may reduce blending time and lessen the possibility of blending errors.

The fuels of the present application may be applicable to the operation of gasoline engines. The engine include both stationary engines (e.g., engines used in electrical power generation installations, in pumping stations, etc.) and ambulatory engines (e.g., engines used as prime movers in automobiles). For example, the fuels may include any and all gasoline fuels, biorenewable fuels, gas-to-liquid (GTL) fuels, synthetic fuels, such as Fischer-Tropsch fuels, biomass to liquid (BTL) fuels, "Biorenewable fuels" as used herein is understood to mean any fuel which is derived from resources other than petroleum. Such resources include, but are not limited to, corn, maize, soybeans and other crops; grasses, such as switchgrass, miscanthus, and hybrid grasses; algae, seaweed, vegetable oils; natural fats; and mixtures thereof. In an aspect, the biorenewable fuel can comprise monohydroxy alcohols, such as those comprising from 1 to about 5 carbon atoms. Non-limiting examples of suitable monohydroxy alcohols include methanol, ethanol, propanol, n-butanol, isobutanol, t-butyl alcohol, amyl alcohol, and isoamyl alcohol.

Accordingly, aspects of the present application are directed to methods for reducing the amount of injector deposits of engines having at least one combustion chamber and one or more direct fuel injectors in fluid connection with the combustion chamber. In another aspect, the quaternary ammonium salts described herein may be combined with relatively high molecular weight quaternary ammonium salts having one or more polyolefin groups; such as quaternary ammonium salts of polymono-olefins, polyhydrocarbyl succinimides; polyhydrocarbyl Mannich compounds: polyhydrocarbyl amides and esters, wherein "relatively high molecular weight" means having a number average molecular weight of greater than 600 Daltons. The foregoing quaternary ammonium salts may be disclosed for example in U.S. Pat. Nos. 3,468,640; 3,778,371; 4,056,531; 4171,959; 4,253,980; 4,326,973; 4,338,206; 4,787,916; 5,254,138: 7,906,470; 7,947,093; 7,951,211; U.S. Publication No. 2008/0113890; European Patent application Nos. EP 0293192; EP 2033945; and PCT Application No. WO 2001/110860.

In some aspects, the methods comprise injecting a hydrocarbon-based fuel comprising the quaternary ammonium salt of the present disclosure through the injectors of the engine into the combustion chamber, and igniting the fuel. In some aspects, the method may also comprise mixing into the fuel at least one of the optional additional ingredients described above.

In one embodiment, the fuels of the present application may be essentially free, such as devoid, of conventional succinimide dispersant compounds. In another embodiment, the fuel is essentially free of a quaternary ammonium salt of a hydrocarbyl succinimide or quaternary ammonium salt of a hydrocarbyl Mannich compound having a number average molecular weight of greater than 600 Daltons. The term "essentially free" is defined for purposes of this application to be concentrations having substantially no measurable effect on injector cleanliness or deposit formation.

EXAMPLES

The following examples are illustrative of exemplary embodiments of the disclosure. In these examples as well as elsewhere in this application, all parts and percentages are by weight unless otherwise indicated. It is intended that these examples are being presented for the purpose of illustration only and are not intended to limit the scope of the invention disclosed herein.

Comparative Example 1

Conventional Polyisobutylene-succinimide (PIBSI)

An additive was produced from the reaction of a 950 number average molecular weight polyisobutylene succinic anhydride (PIBSA) with tetraethylenepentamine (TEPA) in a molar ratio of PIBSA/TEPA=1/1. A modified procedure of U.S. Pat. No. 5,752,989 was used. PIBSA (551 g) was diluted in 200 grams of aromatic 150 solvent under nitrogen atmosphere. The mixture was heated to 115° C. TEPA was then added through an addition funnel. The addition funnel was rinsed with additional 50 grams of solvent aromatic 150 solvent. The mixture was heated to 180° C. for about 2 hours under a slow nitrogen sweep. Water was collected in a Dean-Stark trap. The product obtained was a brownish oil.

Comparative Example 2

PIBSA-DMAPA-E6

PIBSI is prepared as in comparative example 1 except that dimethylaminopropylamine (DMAPA) was used in place of TEPA. The resulting PIBSI (PD, about 210 g) was reacted with 36.9 grams of 1,2-epoxyhexane (E6), 18.5 grams of acetic acid, (18.5 g) and 82 grams of 2-ethylhexanol up to 90° C. for 3 hours. Volatiles were removed under reduced pressure to give the desired quaternary salt (quat).

Comparative Example 3

PIBSA-DMAPA-dimethyloxalate

PIBSI from comparative example 2 (146 g) was reacted with 13.3 grams of dimethyl oxalate in 50 grams of aromatic solvent 150 at 150° C. for about 2 hours. The resulting product was a brownish oil.

Inventive Example 1

$(C_8)_3NMe$

Trioctylmethylammonium chloride (70 grams) was mixed with 130 grams of heptane. The mixture was extracted five times with 70 grams of sodium acetate (about 16% wt. in water). Volatiles from the resulting organic layer were removed under reduced pressure to give a quat acetate. FTIR showed strong peaks at 1578 and 1389 $cm^{-1}$, characteristic of a carboxylate salt.

Inventive Example 2

$(C_{12})_2NMe_2$

A commercial quaternary ammonium product $2C_{12}NMe_2+NO_2^-$ was vacuum distilled to remove volatiles to give the desired product.

Inventive Example 3

$C_{18}NMe_2$-E6

A mixture of $C_{18}$—N-$Me_2$ (118 g), 39 grams of 1,2-epoxyhexane, 26 grams of acetic acid, and 76 grams of 2-ethylhexanol were heated slowly to 90° C. under inert atmosphere. The mixture was heated at 90° C. for 1.5 hours. Volatiles were then removed under reduced pressure to give desired product.

Inventive Example 4

Dimethyl Soy Amine (DMSD) with $C_{14}$-Methyl Salicylate (MS14)

A. Preparation of Alkylated Methyl Salicylate. To a flask was added solid acid resin (28 g), 1-tetradecene (262 g), and methyl salicylate (102 g). The mixture was heated at 130° C. for 2.5 hours followed by 135° C. for about 10 hours. The mixture was filtered. Unreacted methyl salicylate was removed from the mixture under reduced pressure. The alkylated product (MS 14) was obtained as a yellowish liquid (262 g).

B. Quaternization of DMSD with MS14. A mixture of DMSD (100 g) and MS 14(90 g, about 0.6 equivalents) was heated at 160° C. for about 5 hours to provide a brownish oily liquid mixture. The mixture was used without further purification.

Inventive Example 5

Oleylamido Propyldimethylamine with $C_{14}$-Methyl Salicylate (MS14)

A mixture of oleylamidopropyl dimethylamine (OD, 85 g) and $C_{14}$-Methyl Salicylate (MS14, 103 g) was heated at 160° C. for 4 hours to give a quaternary ammonium reaction product without further purification. There was about 90% wt. of nonvolatile materials in the reaction product.

Inventive Example 6

Oleylamido Propyldimethylamine with Propylene oxide and Oleic Acid

A mixture of oleylamido propyl dimethylamine, propylene oxide and oleic acid in about 1 to 1 to 1 molar ratio was heated to about 50° C. in a pressured vessel until completion of reaction. The resulting product was a brownish viscose oil.

Thermogravimetric analysis (TGA) of the compounds of the comparative and inventive examples was conducted complying with ISO-4154. Specifically, the test was run from 50° to 900° C. at a rate of temperature increase of 20° C. per minute under a nitrogen atmosphere at a flow rate of 60 mL per minute. The results of TGA analysis of the comparative and inventive examples is shown in Table 1.

TABLE 1

| Example | Additive | Active wt loss % at 350° C. (TGA) |
|---|---|---|
| 1 | Compound of Comparative Example 1 | 7 |
| 2 | Compound of Comparative Example 2 | 24 |
| 3 | Compound of Comparative Example 3 | 22 |
| 4 | Compound of Inventive Example 1 | 100 |
| 5 | Compound of Inventive Example 2 | 100 |
| 6 | Compound of Inventive Example 3 | 100 |
| 7 | Compound of Inventive Example 4 | 97 |
| 8 | Compound of Inventive Example 5 | 97 |
| 9 | Compound of Inventive Example 6 | 100 |

An engine test measuring fuel injector deposit (referred to as "DIG test") was performed following a procedure disclosed in Society of Automotive Engineer (SAE) International publication 2009-01-2641 "Test and Control of Fuel Injector Deposits in Direct Injected Spark Ignition Vehicles". A mathematical value of Long Term Fuel Trim (LTFT) was used to gauge the ability of additive to keep deposit from accumulating in the injectors, or to keep injectors clean. The higher the LTFT, the more deposit in the injectors and the less effective is the additive in keeping injectors clean.

The test may also be used to gauge the effectiveness of additives to clean up the injectors in a gasoline engine by running a standard 48 hour dirty up phase followed by a 48 hour clean up phase.

For the DIG test, a 2008 General Motors Pontiac Solstice GXP equipped with a DISI 2.0 liter turbocharged 1-4 engine was used. The results are shown in the following table.

TABLE 4

| Run No. | Additives and treat rate (ppm by weight) | Normalized LTFT % | % Improvement |
|---|---|---|---|
| 1 | Gasoline with no additive | 20.4 | — |
| 2 | Compound of Inventive Example 2 (75 ppmw) | 4.70 | 77.0 |
| 3 | Gasoline with typical Mannich detergent (154 ppm) | 17.2 | 15.7 |

TABLE 5

| Run No. | Additives and treat rate (ppm by weight) | Normalized LTFT % | % Improvment |
|---|---|---|---|
| 4 | Gasoline with typical Mannich detergent (154 ppm) | 12.0 | — |
| 5 | Fuel and additive of Run 4 plus 8 ppm of Inventive Example 2 as a top treat | 7.0 | 42 |
| 6 | Fuel and additive of Run 4 plus 8 ppm of Inventive Example 6 as a top treat | 0 | 100 |

Run 1 shows the effects of gasoline with no additive on injectors in a directed injected gasoline engine. Run 2 containing the quaternary ammonium salt of the disclosure showed a significant clean up dirty injectors for a DIG engine at a relatively low treat rate. When used as a top treat the compounds of inventive Examples 2 and 6 showed significant and unexpected improvement in the clean up of dirty injectors in the DIG engine in combination with a conventional Mannich detergent compared to Run No. 4 containing only the Manich detergent.

The advantages of the quaternary ammonium salt of the disclosure are further illustrated by FIG. 1. In FIG. 1, a gasoline fuel containing no additive (Arrow A) is used in a directed injected gasoline engine for the first 48 hours. At point B, the additive of inventive Example 2 (Arrow C) is added to the gasoline and the resulting LTFT % decreased rapidly and maintained a low LTFT % for the remainder of the test.

Port Fuel Injectors (PFI) Bench Test Protocol ASTM D6421 Modified

The following test method is a bench test procedure that was used to evaluate the tendency of automotive spark-ignition engine fuels to foul electronic port fuel injectors (PFI) in a spark ignition engine. The test method used a bench apparatus equipped with Bosch injectors specified for use in a 1985-1987 Chrysler 2.2-L turbocharged engine. The test method was based on a test procedure developed by the Coordinating Research Council (CRC Report No. 592) for predicting the tendency of spark-ignition engine fuel to form deposits in small metering clearances of fuel injectors in a port fuel injection engine. Fuel injector fouling was calculated according to the following equation:

$$F_o = \frac{F_1 - F_2}{F_1} \times 100$$

where $F_0$ is the percent fouling, $F_1$ is an initial flow mass in tenths of a gram, and $F_2$ is a flow mass at the end of the test in tenths of a gram. The percent fouling was calculated for each injector for three flow mass readings and the average of four injectors was reported in percent.

TABLE 6

| Run No. | Additives and treat rate (ppm by weight) | Average % Fouling ($F_o$) |
|---|---|---|
| 1 | Base Fuel | 42.53 |
| 2 | Base Fuel Plus Conventional Mannich Detergent (200 ppmw) | 19.7 |
| 3 | Base Fuel Plus Compound of Inventive Example 4 (75 ppmw) | 6.21 |
| 4 | Base Fuel Plus Compound of Inventive Example 5 (75 ppmw) | 4.38 |
| 5 | Base Fuel Plus Compound of Inventive Example 6 (75 ppmw) | 0.95 |

As shown by the foregoing table, a fuel containing the compound of Inventive Examples 4 and 5 and 6 provided significant improvement in injector fouling in a port fuel injected gasoline engine as compared to the base fuel without any detergent and as compared to the same base fuel containing a conventional Mannich detergent even at a lower treat rate of the Inventive compound.

It is noted that, as used in this specification and the appended claims, the singular forms "a," "an," and "the," include plural referents unless expressly and unequivocally limited to one referent. Thus, for example, reference to "an antioxidant" includes two or more different antioxidants. As used herein, the term "include" and its grammatical variants are intended to be non-limiting, such that recitation of items in a list is not to the exclusion of other like items that can be substituted or added to the listed items For the purposes of this specification and appended claims, unless otherwise indicated, all numbers expressing quantities, percentages or proportions, and other numerical values used in the specification and claims, are to be understood as being modified in all instances by the term "about." Accordingly, unless indicated to the contrary, the numerical parameters set forth in the following specification and attached claims are approximations that can vary depending upon the desired properties sought to be obtained by the present disclosure. At the very least, and not as an attempt to limit the application of the doctrine of equivalents to the scope of the claims, each numerical parameter should at least be construed in light of the number of reported significant digits and by applying ordinary rounding techniques.

While particular embodiments have been described, alternatives, modifications, variations, improvements, and substantial equivalents that are or can be presently unforeseen can arise to applicants or others skilled in the art. Accordingly, the appended claims as filed and as they can be amended are intended to embrace all such alternatives, modifications variations, improvements, and substantial equivalents.

What is claimed is:

1. A fuel composition for a direct fuel injected internal combustion gasoline engine comprising: a major amount of fuel and from about 5 to about 200 ppm by weight of a quaternary ammonium salt having a thermogravimetric analysis (TGA) weight loss of greater than 50 wt.% at 350° C., wherein the quaternary ammonium salt present in the fuel is sufficient to improve performance of the direct fuel injected engine having combusted said composition compared to the performance of said engine having combusted a fuel composition that does not contain said quaternary ammonium salt, and wherein the quaternary ammonium salt is a compound of the formula

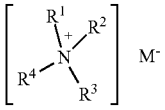

wherein each of $R^1$, $R^2$, $R^3$, and $R^4$ is selected from a hydrocarbyl group containing from 1 to 25 carbon atoms, wherein at least one and not more than three of $R^1$, $R^2$, $R^3$, and $R^4$ is a hydrocarbyl group containing from 1 to 4 carbon atoms and at least one of $R^1$, $R^2$, $R^3$, and $R^4$ is a hydrocarbyl group containing from 8 to 25 carbon atoms, $M^-$ is selected from the group consisting of carboxylates, nitrates, nitrides, nitrites, hyponitrites, carbonates, and mixtures thereof, wherein the carboxylate is not an oxalate or formate.

2. The fuel composition of claim 1, wherein each hydrocarbyl group is independently linear, branched, substituted, cyclic, saturated, unsaturated, or containing one or more hetero atoms.

3. The fuel composition of claim 1, wherein the hydrocarbyl groups are selected from alkyl, alkenyl, and hydroxyl-subsitituted hydrocarbyl groups.

4. The fuel composition of claim 1, wherein the amount of quaternary ammonium salt in the fuel ranges from about 10 to about 150 ppm by weight based on a total weight of the fuel.

5. The fuel composition of claim 1, wherein the amount of quaternary ammonium salt in the fuel ranges from about 30 to about 100 ppm by weight based on a total weight of the fuel.

6. The fuel composition of claim 1, wherein said improved engine performance comprises a reduction in long term fuel trim (LTFT) of greater than about 20%.

7. The fuel composition of claim 1, wherein said improved engine performance comprises a reduction in long term fuel trim (LTFT) of at least 30%.

8. The fuel composition of claim 1, wherein said improved engine performance comprises a reduction in long term fuel trim (LTFT) of at least 40%.

9. The fuel composition of claim 1, wherein said improved engine performance comprises a reduction in long term fuel trim (LTFT) of at least 50%.

10. A method of improving the injector performance of a direct fuel injected internal combustion gasoline engine comprising operating the engine on a fuel composition comprising a major amount of fuel and from about 5 to about 200 ppm by weight based on a total weight of the fuel of a quaternary ammonium salt having a thermogravimetric analysis (TGA) weight loss of greater than 50 wt. % at 350° C., wherein the quaternary ammonium salt present in the fuel improves the injector performance of the engine is provided by a reduction in long term fuel trim (LTFT) % of greater than 20%, and wherein the quaternary ammonium salt is a compound of the formula

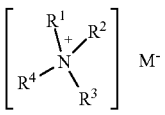

wherein each of $R^1$, $R^2$, $R^3$, and $R^4$ is selected from a hydrocarbyl group containing from 1 to 25 carbon atoms, wherein at least one and not more than three of $R^1$, $R^2$, $R^3$, and $R^4$ is a hydrocarbyl group containing from 1 to 4 carbon atoms and at least one of $R^1$, $R^2$, $R^3$, and $R^4$ is a hydrocarbyl group containing from 8 to 25 carbon atoms, $M^-$ is selected from the group consisting of carboxylates, nitrates, nitrides, nitrites, hyponitrites, carbonates, and mixtures thereof, wherein the carboxylate is not an oxalate or formate.

11. The method of claim 10, wherein each hydrocarbyl group is independently linear, branched, substituted, cyclic, saturated, unsaturated, or containing one or more hetero atoms.

12. The method of claim 10, wherein the hydrocarbyl groups are selected from alkyl, alkenyl, and hydroxyl-subsitituted hydrocarbyl groups.

13. The method of claim 10, wherein the amount of quaternary ammonium salt in the fuel ranges from about 10 to about 150 ppm by weight based on a total weight of the fuel.

14. The fuel composition of claim 10, wherein the amount of quaternary ammonium salt in the fuel ranges from about 30 to about 100 ppm by weight based on a total weight of the fuel.

15. A method of operating a direct fuel injected gasoline engine comprising combusting in the engine a fuel composition comprising a major amount of fuel and from about 5 to about 200 ppm by weight based on a total weight of the fuel of a quaternary ammonium salt having a thermogravimetric analysis (TGA) weight loss of greater than 50 wt. % at 350° C., wherein the quaternary ammonium salt comprises a compound of the formula

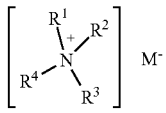

wherein each of $R^1$, $R^2$, $R^3$, and $R^4$ is selected from hydrocarbyl groups containing from 1to 25 carbon atoms, wherein at least one and not more than three of $R^1$, $R^2$, $R^3$, and $R^4$ is a hydrocarbyl group containing from 1 to 4 carbon atoms and at least one of $R^1$, $R^2$, $R^3$, and $R^4$ is a hydrocarbyl group containing from 8 to 25 carbon atoms, $M^-$ is selected from the group consisting of carboxylates, nitrates, nitrides, nitrites, hyponitrites, carbonates, and mixtures thereof, wherein the carboxylate is not an oxalate or formate.

16. The method of claim 15, wherein each hydrocarbyl group is independently linear, branched, substituted, cyclic, saturated, unsaturated, or containing one or more hetero atoms.

17. The method of claim 15, wherein the hydrocarbyl groups are selected from alkyl, alkenyl, and hydroxyl-subsitituted hydrocarbyl groups.

18. The method of claim 15, wherein the amount of quaternary ammonium salt in the fuel ranges from about 10 to about 150 ppm by weight based on a total weight of the fuel.

19. The fuel composition of claim 15, wherein the amount of quaternary ammonium salt in the fuel ranges from about 30 to about 100 ppm by weight based on a total weight of the fuel.

* * * * *